US005325980A

United States Patent [19]

Grimm et al.

[11] Patent Number: 5,325,980

[45] Date of Patent: Jul. 5, 1994

[54] LOCKING VIAL

[76] Inventors: Michael C. Grimm, 25382 Derby Hill Dr., Laguna Hills, Calif. 92653; Philippe F. Bailley, 59 Dearborn, Norwood, N.J. 07648; Joseph W. Price, 116 Via Undine, Newport Beach, Calif. 92663

[21] Appl. No.: 932,798

[22] Filed: Aug. 20, 1992

[51] Int. Cl.[5] ..... B65D 21/02; B65D 51/28; B65D 55/02; B65D 55/16

[52] U.S. Cl. ..... 220/212; 220/375; 220/751; 220/4.27; 220/23.83; 220/524; 220/521; 215/6; 215/213; 215/227; 215/228; 215/306; 604/409

[58] Field of Search ..... 220/214, 212, 318, 375, 220/751, 4.26, 4.27, 23.83, 23.86, 524, 526, 901, 521; 215/6, 211, 213, 216, 227, 228, 258, 306; 604/403, 409, 410, 89, 91

[56] References Cited

U.S. PATENT DOCUMENTS

| | | | |
|---|---|---|---|
| 1,830,939 | 11/1931 | Golden . | |
| 2,569,702 | 10/1951 | Warner . | |
| 3,419,179 | 12/1968 | Deuschle et al. | 220/375 X |
| 3,746,206 | 7/1973 | Utz | 220/214 |
| 4,036,357 | 7/1977 | Czelen | 220/375 X |
| 4,512,484 | 4/1985 | Mar . | |
| 4,574,421 | 3/1986 | Froese | 220/4.27 X |
| 4,658,955 | 4/1987 | Eichner . | |
| 4,787,526 | 11/1988 | Pehr | 215/216 |
| 4,934,547 | 6/1990 | Mayes et al. | 215/306 |
| 4,978,023 | 12/1990 | Behlmann et al. | 220/23.6 |
| 5,012,941 | 5/1991 | Abrams et al. | 215/250 |
| 5,083,674 | 1/1992 | Clark | 220/4.27 |
| 5,086,926 | 2/1992 | Paige et al. | 220/4.27 X |
| 5,180,079 | 1/1993 | Jeng | 220/705 |

*Primary Examiner*—Gary E. Elkins
*Assistant Examiner*—Vanessa Caretto
*Attorney, Agent, or Firm*—Price, Gess & Ubell

[57] ABSTRACT

An improved vial assembly is provided for storing a quantity of material for cryogenic freezing, such as a sample of semen for use in artificial insemination. The vial assembly includes a locking mechanism to prevent the vial from being opened and then reclosed prior to final use. The locking mechanism includes a pair of apertured locking members, one on the vial, and one on the cap of the vial. The locking members are positioned for mutual alignment only when the cap is securely tightened onto the vial. A locking pin is provided for one-way insertion through the apertures of the locking members to prevent the cap from being removed without severing or destroying the locking pin. With this locking mechanism, the integrity of the contents of the vial is substantially ensured until the vial is selected for use and the locking pin is severed in the presence of a patient recipient. A secondary vial is also provided which mounts to the main vial. The secondary vial holds a small quantity of a sample contained within the main vial for use in determining the viability of the sample of the main vial. The entire vial assembly is connected together into a single, generally cylindrical unit, which may be mounted to a mounting bar for insertion into a cryogenic bath.

17 Claims, 6 Drawing Sheets

LOCKING VIAL

BACKGROUND OF THE INVENTION

1. Field of the Invention

The invention relates generally to vials and, particularly, to medical vials for storing semen.

2. Description of Related Art

Recently, techniques have been developed for artificially inseminating semen of a donor within a patient recipient. Typically, the semen must be stored, in a frozen state, for months or years prior to insemination. Accordingly, durable containers must be provided for safely and securely holding the semen within a cryogenic environment, such as a liquid nitrogen bath, until insemination.

Conventionally, small plastic vials having screw-on caps are used. A group of vials of uniform size and shape are mounted to a mounting rod prior to insertion into a liquid nitrogen bath. The mounting rod has sets of parallel flanges. The vials are snapped onto the mounting bar with each vial secured by a pair of flanges. The mounting bar is inserted vertically within the liquid nitrogen bath, with an upper end of the bar remaining above the surface of the liquid nitrogen to allow the rod to be easily inserted and removed.

Thus, once the semen of a donor is inserted into the vial, the cap is tightened onto the vial. Then the vial is mounted to the mounting bar and inserted into the liquid nitrogen bath. When the sample of semen is selected for use, the vial is removed from the bath, inserted within a smaller liquid nitrogen vessel, and shipped to a doctor's office. There, shortly prior to insemination, the vial is removed from the temporary liquid nitrogen vessel and allowed to thaw in hot water. The process of thawing typically takes five to ten minutes. Once thawed, the semen is examined for viability and, if viable, inseminated into the recipient patient.

The conventional vials provide a vessel which is suitably durable to withstand long-term freezing. However, the conventional vials have several drawbacks. Since the vials must be stored for months or years before use, it is important to ensure that the content of the vials cannot be tampered with. However, conventional vials are not tamper-proof, i.e., it is conceivable that the vials can be opened and the contents removed and replaced prior to final insemination. Thus, the integrity of a conventional semen storage system cannot be ensured.

Another drawback is that conventional vials do not include a secondary vessel for storing a test sample. Rather, a single vessel is provided for containing a sample of semen. Occasionally the samples, once thawed, are found to be not viable. With conventional vials, there is no easy means for keeping a sample portion of the semen at the cryogenic facility for testing the viability of the semen prior to shipment.

Finally, the conventional cylindrical vial is not adequately held within the mounting bars. Occasionally a vial may be accidentally detached from the mounting bar. A detached vial sinks to the bottom of the liquid nitrogen bath, where it is extremely difficult to retrieve.

SUMMARY OF THE INVENTION

Accordingly, it can be appreciated that there exists a need to provide a new and improved vial having a substantially tamper-proof cap for ensuring that the vial cannot be opened and reclosed prior to use. There is a further need to provide a vial with a secondary chamber for maintaining a test quantity of the semen which can be detached from the main vial prior to use to provide a separate sample for determining viability of the semen. Further, there is a need to provide a vial which can be more securely attached to mounting bars for insertion into a cryogenic bath to ensure that the vial does not become detached from the mounting bar within a cryogenic bath at a cryogenic facility.

These and other objects of the invention are achieved by the provision of a vial assembly having a closeable, reopenable vial provided with means for ensuring that the vial cannot be reclosed once opened. To this end, the vial assembly includes a cylindrical main vial with a threaded cap for securely screwing onto the main vial. Both the main vial and the cap include apertures mounted to their periphery and relatively positioned such that they are mutually aligned only while the cap is securely mounted to the vial. A locking pin is provided for insertion through the aligned pair of apertures. The locking pin includes a head, a conical nose, and a shaft connecting the head and the nose. The nose is sized for one-way insertion through the apertures such that, once inserted, the locking pin cannot be removed without destroying the pin. When inserted, the nose of the locking pin is received within an enclosed cavity formed within the aperture of the vial. To open the vial, the locking pin must be severed along its shaft. Once severed, the nose portion remains securely mounted within the cavity such that the cap cannot be remounted within a second locking pin.

Thus, the provision of the mutually aligned apertures and the locking pin sized for one-way insertion through the apertures ensures that, once closed, the vial cannot be opened and then reclosed.

In an alternative embodiment, rather than providing a pair of apertures in combination with a separate locking pin, the entire periphery of the cap or at least a portion of the periphery is provided with a depending male locking flange. Likewise, the entire periphery of the vial is provided with a female aperture or slot for receiving the depending locking member. As the cap is screwed onto the vial, the depending locking flange is inserted into the circumferential aperture of the vial. The depending flange is provided with an enlarged head or arrowhead around its periphery which is forced in a one-way locking operation within a smaller female cavity or opening formed around the base of the aperture of the vial. The widened locking head is sized for one-way frictional insertion into the cavity. Thus, once the cap is securely screwed onto the vial, the cap cannot be removed without severing the enlarged locking head from the remainder of the flange of the cap. A portion of the flange can be reduced in size or precut to transmit a compress force during insertion and sever under a tension extraction force. Therefore, as with the preceding embodiment, the cap cannot be remounted once it has been removed.

In accordance with another aspect of the invention, the vial assembly is provided with a second vial chamber. The second vial is mounted to the main vial such that both vials may be stored together as a single unit. The secondary vial is also cylindrical and is mounted coaxially with the main vial, either to a top end or a bottom end of the vial.

In use, when the sample contained within the vial is selected for use, the secondary vial is detached from the main vial and retained at the cryogenic facility. Thus, if the semen of the main vial is later determined to be nonviable, a corroboration may be obtained using the sample of the secondary vial. Alternatively, the viability of the sample in the secondary vial may be tested prior to shipping the main vial.

Preferably, the secondary vial and the main vial are attached by a thin plastic connecting member which is integrally formed with both the main vial and the secondary vial. With the provision of the connecting member, the secondary vial can only be removed from the main vial by cutting or tearing the connecting member. Thus, the secondary vial cannot be removed and then replaced onto the main vial without the severed connecting member providing an indication of the removal.

In any of its various embodiments, the vial assembly of the invention provides a durable and reliable vessel for storing semen within a cryogenic bath. By providing a substantially tamper-proof locking mechanism, the integrity of samples maintained within the cryogenic facility may be maintained. Further, by providing a secondary vial for storing a sample portion of the semen, the sample portion can easily be retained at the cryogenic facility to allow for an independent determination of the viability of the semen.

Although the invention has been described as providing a vial assembly for storing semen, the vial assembly can advantageously be applied to storing any material, particularly where intermediate unauthorized access to the material must be prevented or, at least, detected.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a vial assembly provided with means for allowing the detection of the vial being opened.

Figure 1:
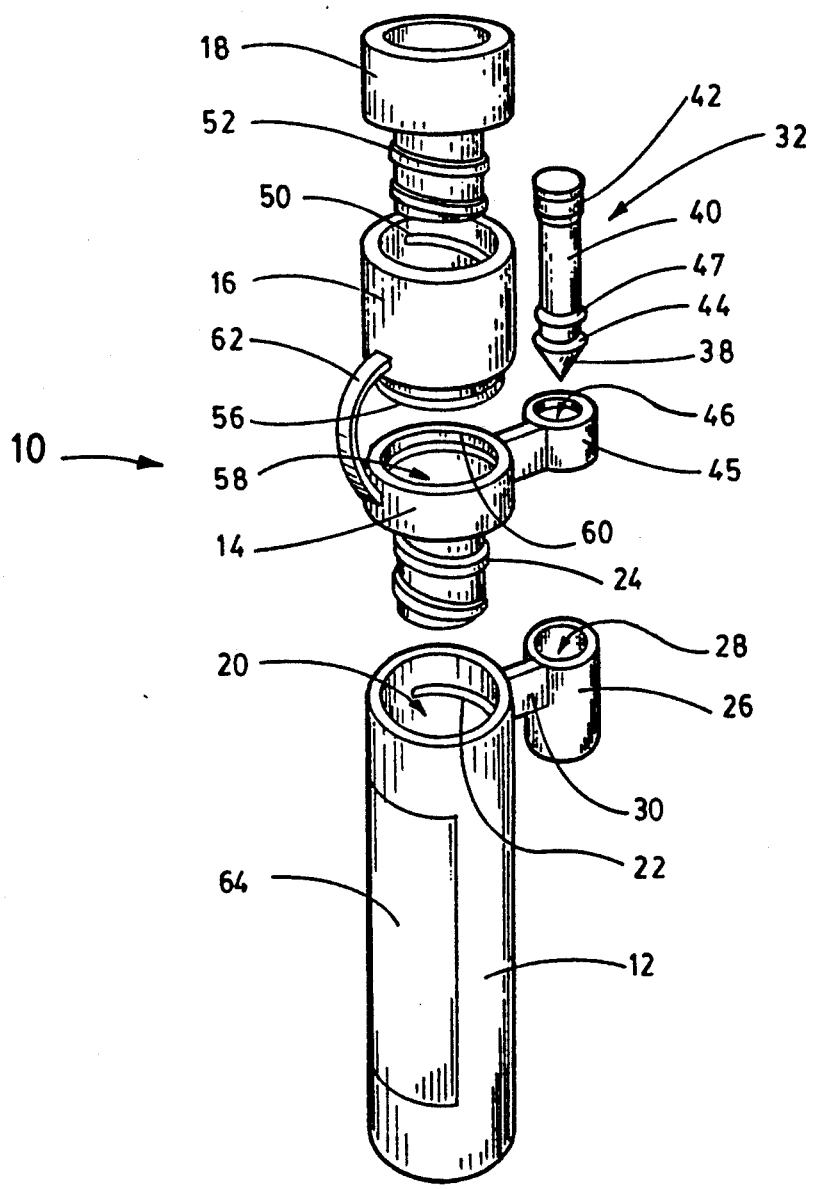
FIG. 1 is a perspective exploded view of a vial assembly constructed in accordance with a preferred embodiment of the invention.
Figure 2B:
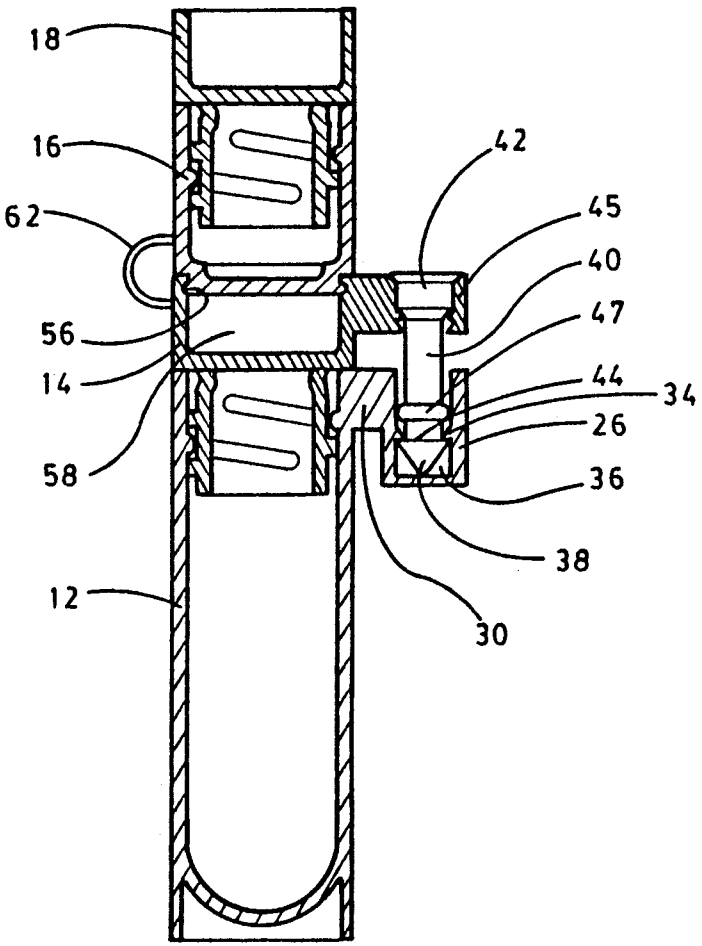
FIG. 2*b* is a cross-sectional view of the embodiment of FIG. 1 showing the components assembled, and showing a locking pin inserted.
Figure 2A:
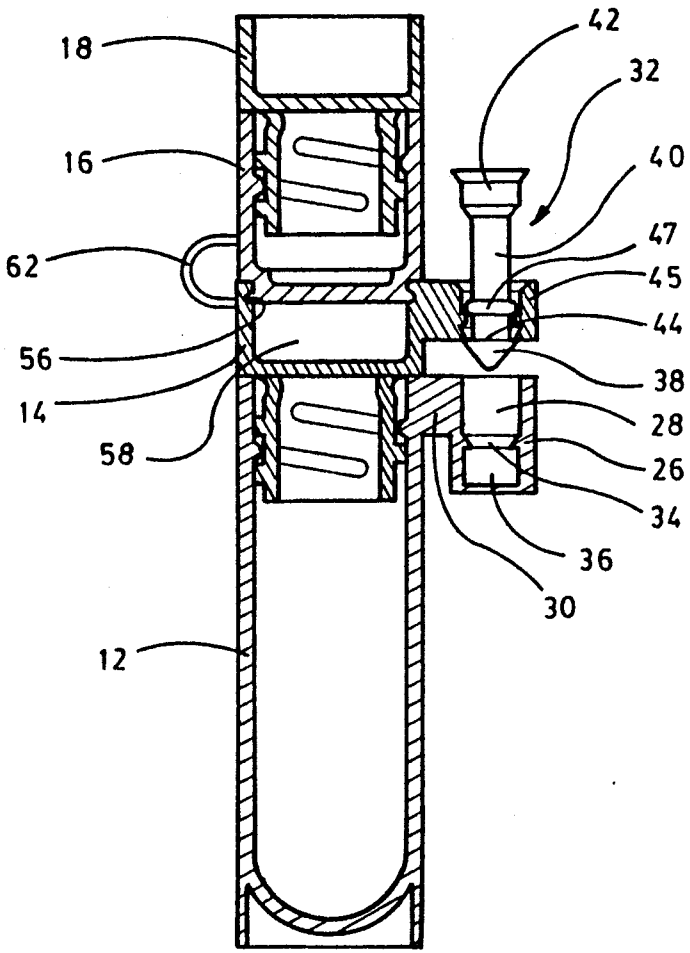
FIG. 2*a* is a cross-sectional view of the vial assembly of FIG. 1 showing the components assembled, but showing a locking pin prior to insertion.
Figure 3:
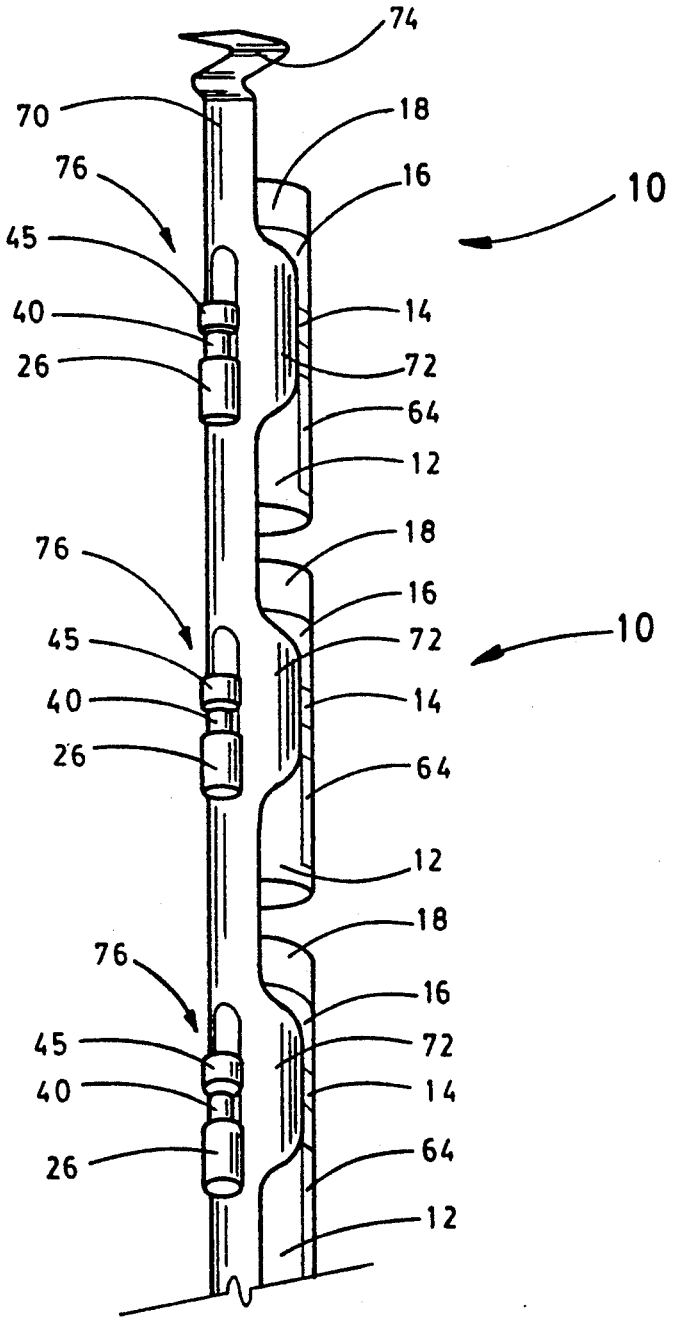
FIG. 3 is a perspective view of a mounting bar shown holding a set of vial assemblies constructed in accordance with the embodiment of FIG. 1.

Referring to FIGS. 1-3, a preferred embodiment of the invention will now be described. A vial assembly 10 is shown having a main vial 12, a main vial cap 14, a secondary vial 16, and a secondary vial cap 18. Main vial 12 is generally cylindrical and forms a chamber 20 for receiving a sample of semen or any other selected material. An upper open end of main vial 12 includes internal threads 22 for engaging with external threads 24 formed on the bottom portion of main vial cap 14. Mutually engaging threads 22 and 24 are provided so that main vial cap 14 may be securely mounted onto main vial 12 for enclosing and sealing the contents.

Main vial 12 includes an apertured locking member 26 mounted to an outer periphery of a top portion of the vial. Locking member 26 includes a vertical cylindrical aperture or shaft 28 oriented coaxially with main vial 12. A connecting member 30 is provided to mount shaft 28 to the outer periphery of main vial 12. Preferably, main vial 12 and locking member 26 are integrally formed together as a single piece of resilient plastic.

Main vial cap 14 also includes an apertured locking member, denoted 45, mounted to an outer periphery of the cap. Locking member 45 includes an aperture or shaft 46 aligned coaxially with cap 14. Shaft 28 of locking member 26 and shaft 46 of locking member 45 are positioned equal distances from the central axis of main vial 12 and main vial cap 14. Further, the respective locking member of the main vial and the main vial cap are mounted on the periphery of the components such that apertures 28 and 46 are aligned, one above the other, only when locking cap 14 is securely mounted into main vial 12. In use, the lower portion of cap 14 is inserted into the upper end of main vial 12 to initiate engagement of the threads. Then, cap 14 is rotated with respect to main vial 12 until the engaging threads cause cap 14 to securely tighten onto main vial 12. The angle and number of turns of thread 24 and the relative position of locking member 45 are configured such that aperture 46 of locking member 45 becomes aligned with aperture 28 of locking member 26 once cap 14 is securely tightened onto vial 12. Once aligned, shaft 46 of locking member 45 and shaft 28 of locking member 26 provide a single vertical conduit for receiving a locking pin 32.

Shaft 28 of locking member 26 is open at the top for receiving locking pin 32. However, shaft 28 is enclosed at the bottom. An inwardly-extending rim 34 is provided around the inner periphery of shaft 28 intermediate the open and closed ends of the shaft. Peripheral rim 34 is integrally formed with an interior wall of shaft 28 and is angled generally downward. A portion of shaft 28 between rim 34 and the closed end of the shaft forms a cavity 36 for receiving a conical nose portion 38 of locking pin 32.

In addition to conical nose portion 38, locking pin 32 includes a central cylindrical shaft 40 and a head or base portion 42. As can be seen from the figures, conical portion 38 includes a rim 44 somewhat larger in diameter than the central shaft 40. Likewise, head 42 is somewhat larger in diameter than shaft 40.

As shown most clearly in FIGS. 2*a* and 2*b*, locking pin 32 is inserted into the apertures by first inserting conical nose portion 32 completely through aperture 46 and into aperture 28. As locking pin 32 is moved downwardly, conical nose portion 38 reaches inner rim 34 of aperture 28. Rim 44 of conical member 38 is preferably sized to have substantially the same diameter as shaft 28. Accordingly, rim 44 is somewhat wider than inwardly-extending peripheral rim 34. Locking rim 34 is formed of a somewhat resilient plastic, as is rim 44 of locking pin 32. Accordingly, conical nose portion 38 may be pressed into cavity 36. Once received within cavity 36, the downwardly-angled aspect of rim 34 prevents conical head portion 38 from being removed from cavity 36.

Locking pin 32 includes a peripheral rim 47, formed just above conical nose portion 38 along shaft 40. Rim 47 has substantially the same diameter as the larger diameter of shaft 46 and is provided to help secure pin 32 within shaft 46 prior to engagement with locking member 26.

Locking pin 32 is sized such that, once conical nose 38 reaches cavity 36, head 42 is disposed against a top end of aperture 46 of locking member 45. Both aperture 46 and head 42 are flared outwardly to allow head 42 to be securely received and positioned within aperture 46. Thus, the top end of locking member 45 and the head of locking pin 32 present a flat surface, with head 42 lying flush within aperture 46 as shown in FIG. 2*b*. This flush configuration ensures that locking member 32 cannot be easily gripped for removal from the apertures.

Once securely inserted, locking pin 32 prevents cap 14 from being rotated with respect to vial 12. Since cap 14 is initially screwed onto vial 12, once cap 14 cannot be rotated with respect to vial 12, it cannot be removed from vial 12. Further, since locking pin 32 and apertures 28 and 46 are sized and configured for one-way insertion of the locking pin, the locking pin cannot be removed without severing or destroying the locking pin. Thus, main vial 12 cannot be opened without visibly damaging or destroying either the locking pin or the locking members. Accordingly, any unauthorized access to the contents of main vial 12 may be detected by examining the locking pin and the locking members. If any of these components has been severed or otherwise damaged or destroyed, then an unauthorized access to main vial 12 may have occurred.

A bottom end of locking member 45 and a top end of locking member 26 are spaced slightly apart to allow access to shaft 40 between the locking members for cutting or severing shaft 40. Thus, once the sample within main vial 12 has been selected for use, a pair of scissors or the like is used to sever shaft 40 of locking pin 32. Once severed, main vial cap 14 may be easily unscrewed from main vial 12. Shaft 40 of locking pin 32 is preferably sized and constructed of a component material to allow the shaft to be fairly easily severed without requiring the application of undue force.

Once severed, the severed bottom half of locking pin 32 remains within shaft 28, with conical nose member 38 remaining within cavity 36. With cavity 36 enclosed at the bottom, the lower portion of the severed locking pin cannot be removed from locking member 26. Thus, the main vial cap cannot be resecured to the main vial by using a new, undamaged locking pin. Therefore, once opened by severing locking pin 32, main vial 12 cannot be relocked.

As noted above, all components of main vial 12 and main vial cap 14 are integrally formed from a resilient plastic. Accordingly, these components may be inexpensively and reliably manufactured using conventional manufacturing techniques. The locking pin is sized for easy and convenient insertion into the apertures of the locking members to allow the main vial cap to be quickly and easily locked onto the main vial. With the provision of the locking members and the locking pin, the contents of the main vial are easily secured from unauthorized access.

With continued reference to FIGS. 1-3, a second desirable feature of the vial assembly 10 will now be described. As noted above, vial assembly 10 includes a secondary vial 16 and a secondary vial cap 18. Together, these components provide a secondary vial or chamber for holding a test sample portion of the specimen of main vial 12. Secondary vial 16 is generally cylindrical and includes an upper inner threaded portion 50 provided for receiving a lower outwardly-threaded portion 52 of cap 18. In use, a portion of specimen stored within main vial 12 is also stored within secondary vial 16. A bottom end of secondary vial 16 includes an outwardly-extending peripheral rim 56. Main cap 14 includes an upper open cavity 58 provided with an inwardly-extending rim or lip 60 for receiving outwardly-extending rim 56 to allow the secondary vial to be snap-fitted onto the main vial.

In use, once a sample portion is placed within secondary vial 16, secondary cap 18 is securely screwed onto the secondary vial. Then the secondary vial is snapped onto the top of main vial cap 14. Hence, a single cylindrical vial assembly is provided, with each component of the vial assembly securely snapped onto or threaded onto one of the other components.

A connecting member 62 may be provided for attaching main vial cap 14 and secondary vial 16. Connecting member 62 is preferably integrally formed with the main vial cap and secondary vial such that the secondary vial can only be completely removed from the main vial by severing or tearing the connecting member. This ensures that the secondary sample vial remains attached to the main vial until needed.

The secondary vial is provided for maintaining a sample portion of the specimen of main vial 12, which can be retained at a cryogenic facility while the contents of the main vial are shipped to a patient recipient. The complete unit of the main vial and the secondary vial are stored together within a mounting bar 70, shown in FIG. 3. Mounting bar 70 is preferably constructed of a lightweight metal such as aluminum, and includes pairs of opposing locking flanges 72. Each pair of locking flanges 72 is sized for receiving and securing a single vial assembly 10. In FIG. 3, only one of each pair of flanges is shown. The other flange of each pair is opposite to the shown flange. Mounting bar 70, with several locking vials, is lowered into a liquid nitrogen bath (not shown) for freezing the contents of the vials. An upper hook 74 remains above an upper surface of the cryogenic liquid to allow the mounting bar to be easily removed from the cryogenic liquid to gain access to the frozen samples. Mounting bar 70 includes a set of vertical slots or openings 76 formed directly between opposing pairs of locking flanges 72. To mount a locking vial assembly to the mounting bar, the locking members 45 and 26 of each vial assembly 10 are inserted through one of slots 76 while the cylindrical portion of the vial assembly is snapped between a pair of locking flanges. Thus, the locking members provide an extending hook which securely hooks into one of the slots to ensure that the vial assembly is not accidentally detached from the mounting bar.

With conventional, entirely cylindrical vials, there is a risk that the vial will slide downwardly between the locking flanges and ultimately sink to the bottom of the cryogenic bath. Once a vial sinks to the bottom of the bath, it is extremely difficult to retrieve.

Main vial 12 preferably includes a label 64, such as a silk screen label, for allowing the contents of the vial to be identified. Label 64 is positioned diametrically opposite from locking member 26. Thus, when the vial assembly is mounted into mounting bar 70 with the locking members inserted through a rear slot, label 64 is oriented forward, where it is easily visible. Conventional vials, provided without a hook member for inserting through the slots, may be inserted into the mounting bar with the label obscured. This not only makes it difficult to read the labels of locking vials mounted to the mounting bar, but friction between the label and the mounting bar may cause written notations on the label to be blurred, scraped, or otherwise rendered unreadable. Thus, the extending locking members provide the additional advantage of ensuring that the labels of the various vials are not obscured when mounted to the mounting bar.

What has been described is a preferred embodiment of a locking vial assembly having a main vial for receiving a specimen, a secondary vial for receiving a smaller portion of the specimen, and a means for securely locking the main vial to prevent unauthorized access to the contents of the main vial. The relative sizes of the main and secondary vials may be chosen as desired. In the embodiment of FIGS. 1–2, the main vial is considerably larger than the secondary vial. In the embodiments shown in FIG. 3, the main and secondary vials are of approximately the same size.

In use, a specimen, such as a semen sample provided for artificial insemination, is stored within main vial 12, which is then securely closed by main vial cap 14. Once the cap is securely mounted to the main vial, locking pin 32 is inserted through locking members 26 and 45 to prevent unauthorized removal of cap 14. A portion of the semen sample is also placed within secondary vial 16, which is secured by cap 18. Information identifying the contents of the vial is written onto label 64. The entire vial assembly is then mounted to mounting bar 70 and inserted into a cryogenic bath, where it is frozen and preserved until the sample is requested for use in artificial insemination. At that time, which may be weeks, months, or years later, the vial having the desired semen specimen is removed from its cryogenic bath. At that time, secondary vial 16 is torn from the main vial and the contents of the secondary vial are allowed to thaw, preferably within a hot water bath. Once thawed, the viability of the semen within the secondary vial is tested. If the semen is not viable, an alternative specimen stored in a different vial may be chosen. If viable, main vial 12 is placed within a temporary cryogenic package and shipped to the office of the doctor requesting the sample. Once received, the contents of the main body are thawed. Then a pair of scissors is used to sever locking pin 32 to allow access to the contents of the main vial. Preferably, this step is performed in the presence of the recipient patient, who can verify that the vial was not previously tampered with, and that the label of the vial properly identifies the desired specimen. Thus, the patient can be assured of receiving the desired semen.

By retaining a sample portion at the cryogenic facility, the viability of the semen may be tested prior to shipping the main vial. Alternatively, the contents of the secondary vial may be retained in a frozen state and thawed and opened for testing only if the contents of the main vial are found to be not viable. If that determination is made, the secondary vial is thawed and the determination of nonviability can be verified or corroborated using the semen in the secondary vial.

To further guard against any possible tampering or unauthorized access to the specimens, the initial placement of the semen sample into the vial should be performed in the presence of the donor, who will sign or initial the label. This precaution helps ensure that the semen sample is not misidentified.

Figure 4:
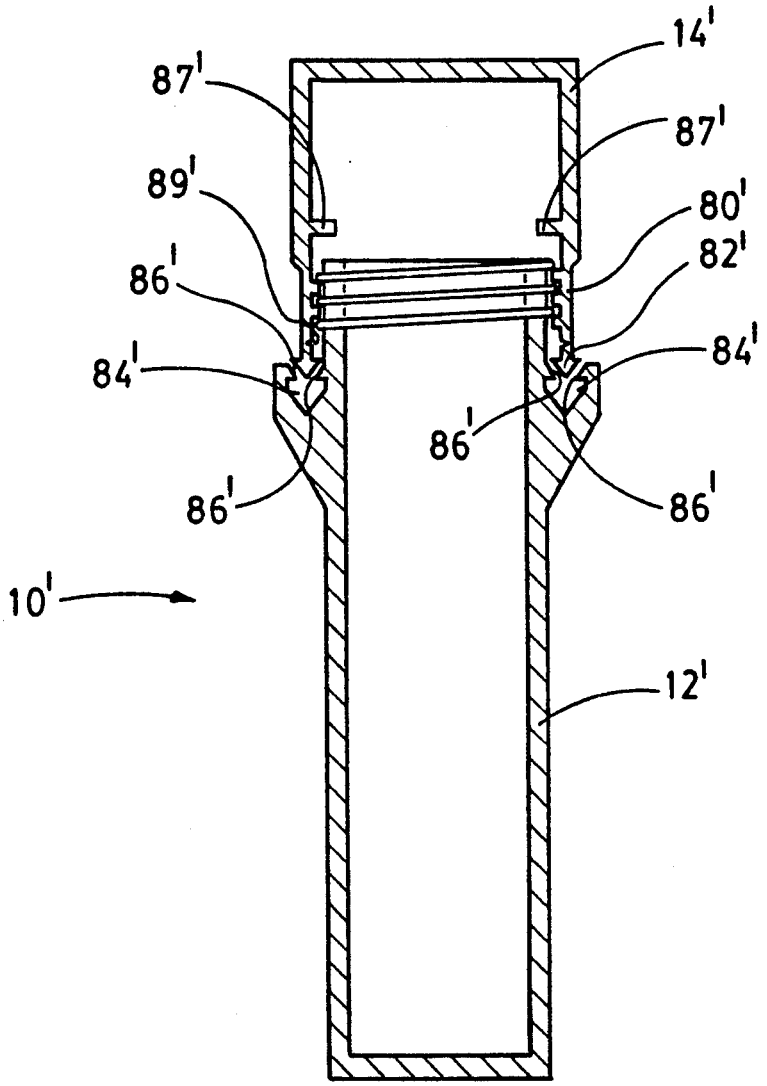
FIG. 4 is an alternative embodiment of a vial assembly, wherein a separate locking pin is not required.

An alternative embodiment of the vial assembly is shown in FIG. 4. The embodiment of FIG. 4 is similar to that of FIGS. 1–3, and like elements are identified with reference numerals with primes attached. In FIG. 4, the vial assembly 10' is shown in cross-section having a vial 12' and a vial cap 14'. In the embodiment of FIG. 4, a secondary vial is not provided. Vial 12' and vial cap 14' include engaging thread portions to allow the cap to be screwed onto the vial. An inner rim or band 87' is provided within cap 14' for abutting or seating on a top end of vial 12' to help seal vial 12'. Cap 14' includes a downwardly-extending peripheral locking member or flange 80', which extends around the entire periphery of cap 14', and includes a widened, male locking head, nose, stake, or arrowhead 82' around its circumference. Locking head 82' may be triangular, as shown, or may have any other suitable enlarged shape.

Vial 12' includes a circumferential or peripheral female slot or cavity 84' formed around the entire periphery of the top end of the vial. Peripheral female cavity 84' is provided for receiving peripheral male locking member 80'. Inwardly-extending rims 86' are provided within shaft 84' for receiving locking head 82'. Peripheral locking member 80' and cavity or slot 84' are sized such that locking head 82' is inserted past rim 86' as cap 14' is securely tightened onto vial 12'. Rims 86' are angled generally downwardly to provide for one-way insertion of locking member 80'. Also, the resilience of head 82' and rims 86' are selected to allow one-way insertion. Once cap 14' is securely tightened onto vial 12', the cap cannot be removed without tearing the locking heads from the peripheral locking member. This ensures that the cap cannot be removed and the contents of the vial tampered with without damage to the locking member being readily apparent. Inner rim 87' is positioned to abut vial 12' only after locking head 82' is fully received within slot 84'. Slot 84' retains the triangular portion of the locking member within the cavity once it has been torn free of cap 14'. Thus, a second, new cap cannot be inserted onto vial 12' once the first cap has been removed from the vial.

To facilitate tearing of locking head 82' from flange 80', a notch or groove 89' is provided along flange 80'. During insertion of head 82' into slot 84', notch 89' compresses to ensure adequate insertion force. However, upon removal of cap 14' from vial 12', notch 89' provides an area of weakness to facilitate tearing of locking head 82' from flange 80'.

Flange 80' need not extend around the entire periphery of cap 14'. Rather, one or more individual flanges, each with a locking head, may be provided in spaced relation around the periphery of cap 14'. Preferably, at least two such individual flanges or stakes are provided in opposing relation. the individual stakes may each be narrow or, alternatively, may subtend a substantial portion of the periphery. In the latter case, each stake may subtend, for example, 20 or 30 degrees. Indeed, the individual stakes may cover almost the entire periphery, leaving only one or two narrow vertical slots between adjacent stakes.

As with the vial assembly previously described, the alternative vial assembly of FIG. 4 is generally cylindrical and is sized for insertion between a pair of locking flanges of the mounting bar of FIG. 3. Although not shown, the alternative vial assembly may also include a label portion for receiving indicia indicating the identifying contents of the vial.

Figure 5:
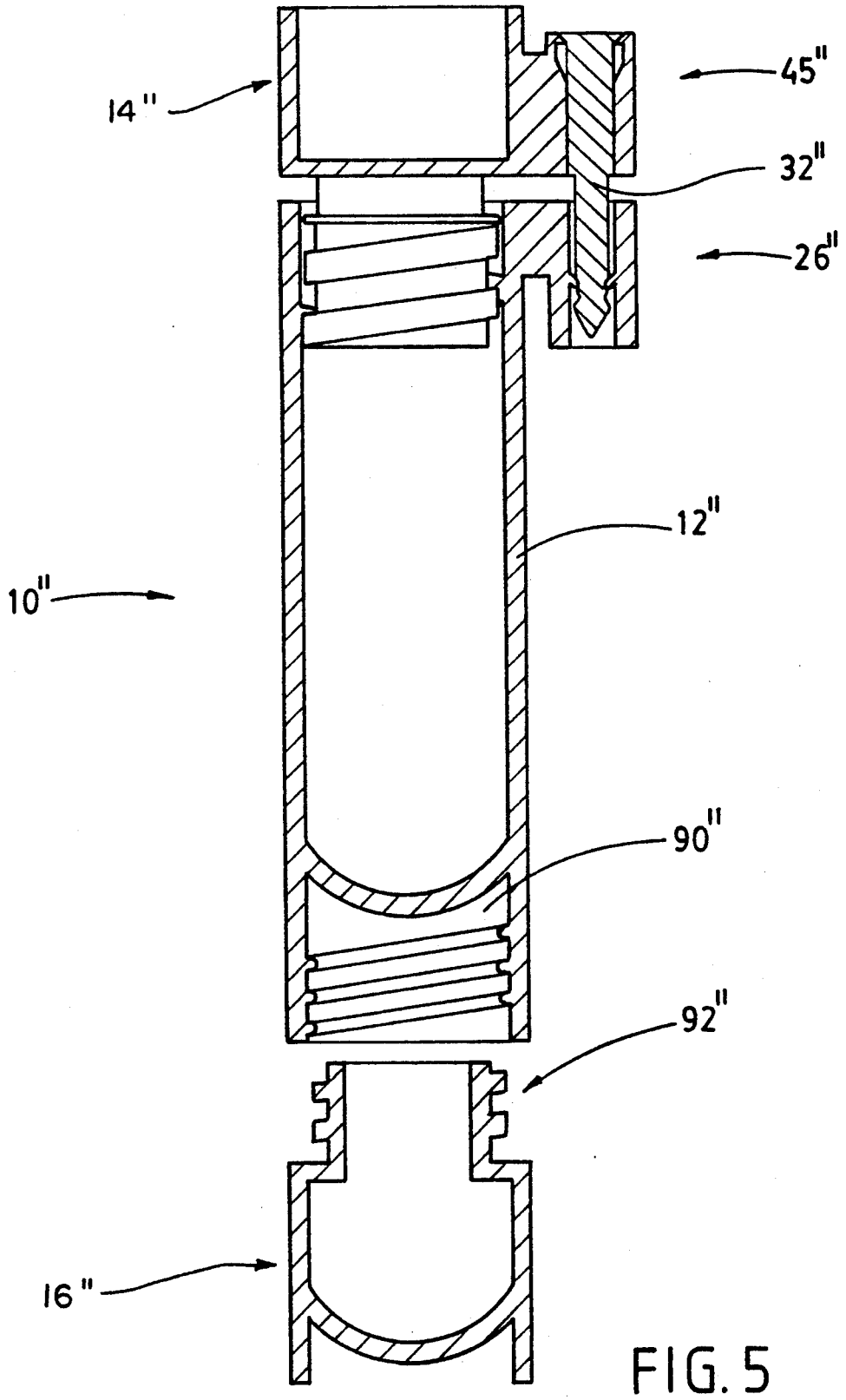
FIG. 5 is a second alternative embodiment of the invention, showing a secondary vial mounted to a bottom portion of the main vial.
Figure 6:
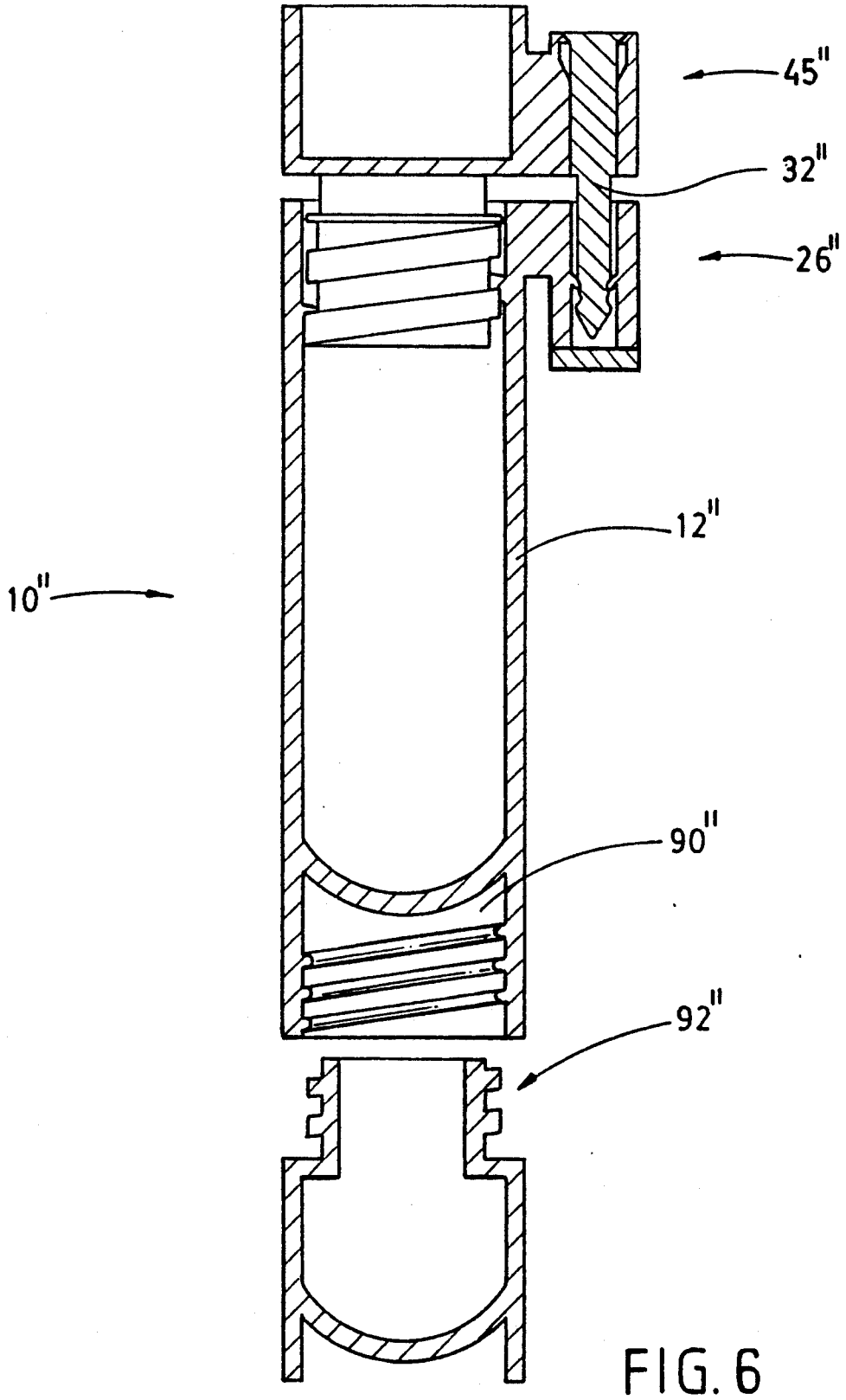
FIG. 6 is a modification of the second alternative embodiment of FIG. 5, with the locking member 26" shown as an enclosed member.

Another alternative embodiment of the vial assembly is shown in FIG. 5. The embodiment of FIG. 5 is similar to that of FIGS. 1–3, and like components are identified with like reference numerals with double primes attached. FIG. 5 provides an alternative vial assembly 10″ similar to that of FIG. 1, including a main vial 12″ and a main vial cap 14″. A pair of mutually aligned locking members 26″ and 45″ are provided. A locking pin 32″ is inserted through the locking members for locking the cap to the main vial to prevent the cap from being removed.

Unlike the embodiment of FIGS. 1–3, the secondary vial 16″ is attached to the bottom end of the main vial, rather than the top of the main vial. To this end, main vial 12″ is provided with an internally-threaded bottom cavity 90″. Secondary vial 16″ includes an externally-threaded upper portion 92″, which is inserted within cavity 90″ and screwed therein. Thus, a sample portion of the contents of the main vial 12″ may be placed within secondary vial 16″, which is securely mounted to the bottom end of the main vial. In this manner, secondary vial 16″ need not include its own separate cap. As with the previous embodiments, the resulting cylindrical vial assembly is mounted within a mounting bar such as shown in FIG. 3.

In a further alternative embodiment (not shown), the secondary vial 16″ may be provided with a cap which would include appropriate threaded portions for connecting the secondary vial 16″ into the main vial 12″.

What has been described are several embodiments of a vial assembly for storing a quantity of material such as a semen sample for use in artificial insemination. The vial assemblies are provided with means for preventing the vial from being opened and the contents tampered with. In two embodiments, a secondary vial is also provided for storing a portion of the specimen contained within the main vial, such that the viability of the speciment of the main vial may be independently corroborated. Each of the embodiments is constructed from components formed of a resilient plastic manufactured by conventional techniques. The vial assemblies can be inexpensively manufactured and quickly assembled and locked when used. The vial assemblies are sufficiently durable to withstand cryogenic freezing for an extended period of time to preserve samples frozen therein. The embodiments having extending locking members provide the further advantage of engaging with slots formed within the mounting bar to prevent the vial assembly from being detached from the mounting bar and to ensure that a label of the vial assembly is not obscured from view.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A locking vial assembly for use in storing semen samples on a mounting member immersed in liquid nitrogen comprising:

a main vial with an aperture member formed along an outer surface thereof and securing means formed along an outer surface thereof for engaging the mounting member and thereby preventing the main vial from being accidentally detached from the mounting member, wherein said securing means comprising a depending hook for insertion through and secure engagement with a slot formed in the mounting member;

a cap for securely closing the vial, the cap also having an aperture, member with the apertures of the cap and the vial being positioned for mutual alignment while the cap securely closes the vial; and a locking pin received in the apertures while the apertures are mutually aligned, the locking pin being sized for one-way insertion through the apertures, the locking pin being removable from the apertures only by severing said locking pin.

2. The locking vial assembly of claim 1, wherein the cap of the main vial is threaded, and wherein the main vial includes means for engaging the threads of the cap.

3. The locking vial assembly of claim 2, wherein the main vial includes a substantially circular threaded base, and wherein the secondary vial includes means for engaging the threaded base of the main vial.

4. The locking vial assembly of claim 1, further including a secondary vial releasably attached to the main vial wherein the cap of the main vial includes an upper rim having an inner peripheral detent, and the secondary vial has a circular base having an outer peripheral rim, with the outer rim of the secondary vial engaging the inner detent of the cap of the main vial for securing the secondary vial to the cap of the main vial.

5. The locking vial assembly of claim 4, wherein the secondary vial is attached to the main vial by a flexible connecting member, the connecting member being integrally formed with the second vial and the cap, the second vial being removable from the cap of the main vial only by severing the connecting member.

6. The locking vial assembly of claim 1, wherein the aperture member of the main vial is a substantially cylindrical shaft formed in a member protruding from a top outside rim of the main vial, and wherein the aperture member of the cap is a substantially cylindrical shaft formed in a member protruding from a top outside rim of the cap, the shafts being of substantially equal diameters and being separated by a distance, while aligned, sufficient to allow access to the locking pin to allow severing of the locking pin.

7. The locking vial assembly of claim 1, wherein the main vial includes a label portion for receiving indicia identifying a semen sample in the main vial.

8. The locking vial assembly of claim 7, wherein the label portion is positioned on the outer surface of the main vial opposite from the securing means.

9. The locking vial assembly of claim 1, further including a secondary vial releasably attached to the main vial wherein an open end of the secondary vial is threaded, and wherein an end of the main vial, opposite an end that is closed by the cap, includes means for engaging the threads of the secondary vial and thereby closing the secondary vial.

10. The vial assembly of claim 1, wherein the depending hook also carries the aperture of the main vial.

11. A locking vial assembly comprising:

a main vial with an aperture member formed along an outer surface thereof;

a cap for securely closing the vial, the cap also having an aperture member, with the apertures of the cap and the vial being positioned for mutual alignment while the cap securely closes the vial; and a locking pin which includes a head, a conical nose, and a shaft connecting the head and the nose, the head of the pin being sized larger than the apertures, the pin being sized for one-way insertion through the apertures while the apertures are mutually aligned, the cap being removable from the main vial only by severing the shaft to separate the conical nose of the pin from the head of the pin and an enclosed cavity for receiving the severed conical nose of the locking pin, the severed conical nose of the pin being irremovably retained in the cavity to prevent insertion of a second pin through the apertures.

12. The locking vial assembly of claim 11, further including a secondary vial releasably attached to the main vial wherein an open end of the secondary vial is threaded, and wherein an end of the main vial, opposite an end that is closed by the cap, includes means for engaging the threads of the secondary vial and thereby closing the secondary vial.

13. The locking vial assembly of claim 11, further including a secondary vial releasably attached to the main vial wherein the cap of the main vial includes an upper rim having an inner peripheral detent, and the secondary locking vial has a circular base having an outer peripheral rim, with the outer rim of the secondary vial engaging the inner detent of the cap of the main vial for securing the secondary vial to the cap of the main vial.

14. The locking vial assembly of claim 13, wherein the secondary vial is attached to the main vial by a flexible connecting member, the connecting member being integrally formed with the secondary vial and the cap, the secondary vial being removable from the cap of the main vial only by serving the connecting member.

15. The vial assembly of claim 11, wherein the aperture member of the main vial is a substantially cylindrical lumen formed in a member protruding from a top outside rim of the main vial, and wherein the aperture member of the cap is a substantially cylindrical lumen formed in a member protruding from a top outside rim of the cap, the lumens being of substantially equal diameters and being separated by a distance, while aligned, sufficient to allow access to the shaft of the locking pin to allow severing of the shaft of the pin.

16. The vial assembly of claim 15, wherein the lumen of the main vial includes an inwardly-extending rim engaging with the conical nose of the pin.

17. A locking vial assembly for use in storing semen samples on a mounting member immersed in liquid nitrogen comprising:

a vial having a threaded top portion;

a cap having a threaded bottom portion for engaging with the vial to securely mount to and close the vial;

a first apertured member extending from a side of the vial and forming a depending hook for insertion through and secure engagement with a slot formed in the mounting member and thereby preventing the vial from being accidentally detached from the mounting member;

a second apertured member extending from a side of the cap, the apertured members being disposed with adjacent apertures while the cap is securely mounted to the vial; and a locking pin for extending through the apertures, the pin having a head larger than the second apertured member, a connecting shaft, and an opposing conical nose having a maximum diameter larger than the first apertured member, the conical nose being resilient to allow one-way insertion through the apertured members, the conical nose being received within an enclosed cavity in the first apertured member, the locking pin being removable from the apertured members only by severing the shaft to separate the conical nose from the head, and the severed conical nose of the pin being irremovably retained in the cavity to prevent insertion of a second pin through the apertures.

* * * * *